United States Patent [19]

Krause

[11] 4,231,586

[45] Nov. 4, 1980

[54] COMBINATION SKI LOCK AND SAFETY STRAP

[76] Inventor: David A. Krause, 5648 Stevens Dr., S., Clay, N.Y. 13041

[21] Appl. No.: 32,382

[22] Filed: Apr. 23, 1979

[51] Int. Cl.[3] ..... A63C 11/02

[52] U.S. Cl. ..... 280/637; 24/73 SG; 70/58; 224/917; 280/814

[58] Field of Search ..... 280/637, 11.37 K, 11.37 A; 70/58, 18, 19; 24/73 SG; 211/60 SK; 224/45 S, 917

[56] References Cited

U.S. PATENT DOCUMENTS

| | | | |
|---|---|---|---|
| 3,272,526 | 9/1966 | Rumaner | 280/11.37 K |
| 3,354,675 | 11/1967 | Quigg | 280/11.37 K |
| 3,452,999 | 7/1969 | Salomon | 280/637 |
| 3,518,853 | 7/1970 | Bolte | 280/11.37 K |
| 3,826,510 | 7/1974 | Halter | 280/637 |
| 3,941,397 | 3/1976 | Kidder et al. | 280/637 |

*Primary Examiner*—David M. Mitchell
*Attorney, Agent, or Firm*—Bruns & Jenney

[57] ABSTRACT

A combined ski locking device and safety strap assembly that includes a riser strap affixed to the ski, a loop strap that is arranged to be closed about the skier's leg by any conventional fastener means, and a lock that cojoins the riser strap and the loop strap. In assembly, the loop strap is received in close sliding relationship within the lock and contains a pair of stop members that are spaced apart along its length to limit the extent of travel afforded the strap within the lock. A link is also secured to one end of the strap that can be united with the shackle of the lock. In practice, when used as a security device, the loop strap is first pulled to a fully extended position in the lock and the extended strap passed through the ski equipment and around a fixed object. The link is then clasped in the lock to secure the equipment.

11 Claims, 3 Drawing Figures

COMBINATION SKI LOCK AND SAFETY STRAP

BACKGROUND OF THE INVENTION

This invention relates to a combined ski lock and safety strap assembly and, in particular, to a safety strap that can be used in a conventional manner to secure a ski to the user's leg and thus prevent a runaway condition and, at the skier's option, used as a security device for locking various pieces of ski equipment to a fixed object such as a ski rack or the like.

The most pertinent prior art known to the applicant at the time of filing this application is embodied in the following United States patents:

U.S. Pat. Nos. 3,941,397; 3,826,510; 3,518,853; 3,354,675; 3,272,526.

Recently there has been a rapid growth in the sport of recreational skiing which is to a large extent due to the great advancements made in both ski equipment and skiing facilities. With improvement in equipment has come an increase in the cost of this equipment and, sadly to say, a rise in the amount of thievery that takes place when this equipment is left unattended.

Many devices have been developed in an attempt to prevent the theft of skis and poles. However, as evidenced by some of the above-noted patents, most of these devices involve locking mechanisms that must be carried on the skier's person when not in use. As a result, they pose a safety hazard in the event the skier experiences a fall. These devices also represent an added piece of inconvenient gear which oftentimes is forgotten or purposely left at home. Lastly, most of these security devices are relatively costly and are complex in their operation.

In the noted U.S. Pat. No. 3,826,510 patent a combined ski lock and safety strap assembly is disclosed wherein a cable is secured to the ski and the ends of the cable wound or looped a number of turns about the skier's leg before being united by means of a locking unit. The locking unit is provided with a two-position control mechanism which allows free release of the cable when it is placed in a first position and locks the ends of the cable together when placed in a second position. As can be seen, the lock can readily become fouled with ice and snow when used as safety strap thereby making it very difficult to remove from the user's leg. Similarly, the position of the control mechanism can be inadvertently changed due to a fall or the like which again make the safety strap difficult to remove. The relatively bulky lock must also be positioned against the user's leg and thus can cause bodily harm during a fall or a collision.

SUMMARY OF THE INVENTION

It is therefore an object of the present invention to improve safety straps used in skiing.

A further object of this invention is to provide a combined ski lock and safety strap assembly that is convenient to use and which does not have to be locked to the skier's leg.

A still further object of the present invention is to provide a relatively inexpensive ski lock that is carried on the skis and which only has to be locked or unlocked in the event the user wishes to secure his equipment to a fixed object such as a ski rack or the like.

Another object of the present invenion is to provide a combined ski lock and safety strap assembly wherein the lock itself will pose little or no danger to the skier in the event of a fall or collision.

These and other objects of the present invention are attained by means of a combined ski lock and safety strap that includes a lock having a shackle that is receivable in a body to provide a clasping means for locking a third element therein, a loop strap is slidably mounted in the lock that contains a pair of stops for limiting the amount of travel afforded the loop within the lock, a link is secured to one end of the loop strap that is receivable in the shackle and a riser strap extending between the ski and the lock for securing the lock to the ski.

BRIEF DESCRIPTION OF THE DRAWING

For a better understanding of these and other objects of the present invention reference is had to the following detailed description of the invention which is to be read in conjunction with the accompanying drawings, wherein.

DESCRIPTION OF THE INVENTION

With reference to the drawings, there is shown a combined ski security device and safety strap assembly, generally referenced 10, which is conveniently affixed to a ski and used in a conventional manner to prevent the ski from "running away". At the user's option, the safety strap can also be utilized to securely lock his or her ski equipment to a fixed object and thereby prevent the equipment from being stolen. The fixed object will typically be a ski rack as normally found about ski lodges or a ski carrier that is mounted upon a motor vehicle. In any event, it has been found that when ski equipment is mounted in these types of racks, the equipment can be secured to the rack using a relatively short strap. Accordingly, as will be explained below, a safety strap of normal length can be employed to carry out an added security function without having to resort to the use of additional straps, cables or the like.

Figure 1:
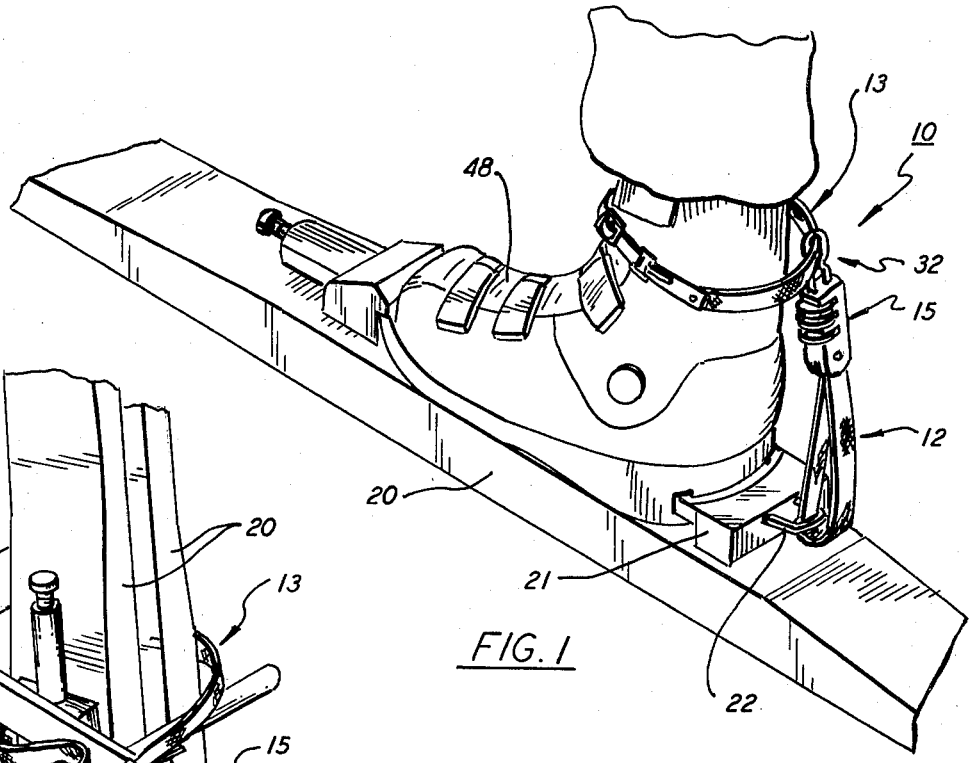
FIG. 1 is a perspective view of a combined ski lock and safety strap assembly embodying the teachings of the present invention illustrating the device operatively connected to a skier's leg.

The present apparatus includes a riser strap 12, a loop strap 13, and a lock 15 interconnecting the two straps. Both straps are preferably formed of a high strength nylon webbing or any other suitable high strength material as known and used in the art. The two ends of the loop strap are provided with a coacting fastening means for permitting the loop to be closed about the skier's leg as illustrated in FIG. 1. In this particular embodiment of the invention, the fastening means comprises a spring-like clasp secured at one end of the loop strap and a closed link 19 secured at the other end thereof.

When used as a safety device, the loop is passed about the skier's leg and the closed link is snapped beneath the spring-like clasp thereby closing the loop. The exact nature of the fastening means, however, is not important to the invention and any conventional fastening means may be employed without departing from the teachings of the present invention. In this particular embodiment the closed link 19 carries out one additional function which will be explained in further detail below.

In assembly, the riser strap is affixed to the back of a ski 20 and secured to the lock so that the riser acts as a tether to enable the lock to be elevated a short distance above the ski. Grommets 23—23 are passed through the webbing at each end of the riser strap which are formed of metal and have an opening therein for slidably accepting a rivet 25. The riser is looped through a suitable part of the heel binding 21, such as cleat 22, and the two grommets positioned in alignment within a slotted opening 27 formed in the body section 37 of the lock. A hole 29 is passed through the walls 30—30 of the slotted opening that is also able to accept the rivet. In assembly, the rivet is passed through the hole and the two grommets and the ends thereof peened over to affix the lock to the riser and, at the same time, secure the riser to to the ski.

The lock, in addition to the body section, also includes a male shackle 32 that is insertable into the body section and which can be locked thereto. The shackle is an elongated U-shaped member that is crimped or deformed inwardly about its central region to create a closed contoured aperture 35 at the top thereof. The aperture is contoured to receive the loop strap in close sliding relationship therein.

A pair of stops 40—40 are affixed to the loop strap on either side of the shackle to limit the extent of travel afforded the strap within the aperture. In practice, the stops may be metal rivets that are securely mounted at strategic positions within the strap webbing. The size and/or shape of the rivets is such that the rivet is incapable of passing through the aperture formed in the shackle. One of the stops is positioned at the end of the loop strap opposite that in which the link is secured. The other stop can be placed at about the middle of the strap to help position the strap in the shackle when the apparatus is being used as a safety device.

The open end of the shackle forms a male section 36 that is adapted to be received in openings (not shown) provided in the body section of the lock. The lock is preferably a combination type lock containing a plurality of locking rings 39—39 that are rotatably supported in the body section as shown. In practice, the shackle can be inserted into the body regardless of the combination setting but can only be removed when the rings are aligned at the release setting.

Figure 2:
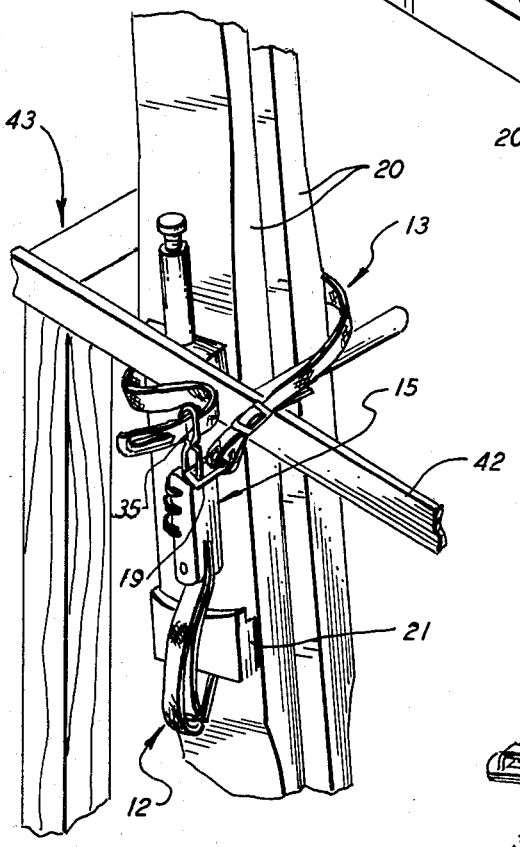
FIG. 2 is also a partial perspective view of a pair of skis that are secured to a ski rack using the apparatus of the present invention as the means for securing the skis to the rack.
Figure 3:
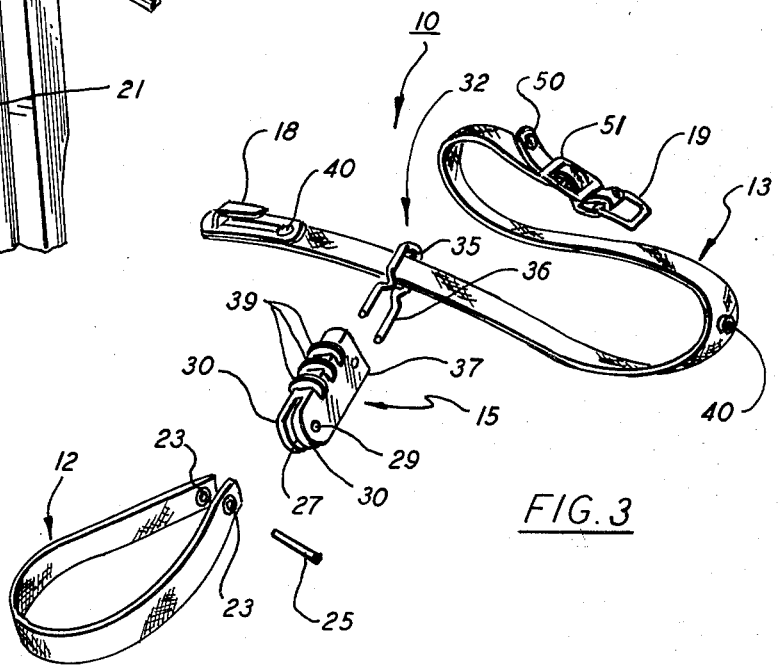
FIG. 3 is an exploded view of the ski lock and safety strap assembly shown in FIG. 1.

As should be evident from the disclosure above, the loop strap is capable of being run out through the shackle to its full extent with the closed link 19 being positioned at the extended end of the loop strap. As best seen in FIG. 2, the extended strap can be passed through parts of the ski equipment, such as the boot bindings and pool loops, and then wrapped about a fixed object, such as the horizontal runner 42 of ski rack 43. After wrapping, the closed link of the loop strap is passed into the shackle and the shackle locked to the body section of the lock. In assembly, the link is securely mounted in the loop strap so that it cannot be removed therefrom without breaking the strap or damaging the link. As shown, a rivet 50 is implanted in the link end of the loop strap which will prevent the strap from being threaded through the adjusting buckle 51 thus securing the link to the strap.

As can be seen, in the present invention the lock 15 serves as a connector between the loop strap and the riser when the shackle is locked in place. As such, the lock is usually suspended loosely behind the skier's boot 48 (FIG. 1) where it is out of the way and well protected from ice and snow. As a result of this mounting arrangement, the lock poses little or no danger to the skier in the event of a fall. The lock, however, is always available for use as a security device if the skier, at his option, cares to use it.

While this invention has been described with reference to the structure disclosed above, it is not necessarily confined to the details as set forth. For example, the loop strap of the device could be slidably received in the body section of the lock, rather than the shackle, without departing from the invention. Similarly, the shackle could also be connected to the riser while the body section of the lock is connected to the loop strap. In summary, this application is intended to cover any modification or changes that might come within the scope of the following claims.

I claim:

1. A combination ski lock and safelty strap that includes a lock having a female body section and a male shackle section receivable therein whereby the male shackle can be locked to the female body section, said lock further including a contoured aperture formed therein in which a strap may be slidably received, a loop strap that is slidably received within the contoured aperture of said lock in close sliding relationship therewith having coacting fastening means at each end thereof for closing said loop and a pair of spaced-apart stops positioned on either side of the lock, said stops being of a size and shape to prevent them from passing through the aperture and thus limit the extent of travel afforded the loop strap within the lock, a link secured in one end of the strap that is receivable in the shackle of the lock so that the link will be secured in the lock when the shackle is locked in the body section thereof, connecting means for securing the lock to a ski.

2. The combination of claim 1 wherein said connecting means is a riser strap that is arranged to rise upwardly adjacent to a skier's leg when the leg is secured to the ski.

3. The combination of claim 2 wherein the riser strap is secured in a heel binding that is affixed to the ski.

4. The combination of claim 1 wherein said stop means are metal rivets secured to the loop strap with one rivet being located at the end of the loop strap opposite that in which the link is secured.

5. The combination of claim 1 wherein said link forms part of the fastening means.

6. The combination of claim 1 wherein said lock includes a combination actuated locking mechanism for locking and unlocking the shackle therein.

7. The combination of claim 1 wherein said contoured aperture is formed in the shackle.

8. A combination ski lock and safety strap including a riser strap secured to a ski at the heel binding location thereof, a lock means having a female body section affixed to a riser and a male shackle that is receivable in locking engagement within the female body, said shackle having a contoured aperture formed therein for slidably receiving a loop strap therein, a loop strap slidably mounted in said aperture in close sliding relationship therewith, said loop strap having coacting fastening means for closing both ends of the strap about the skier's leg, a pair of spaced apart stops secured to the loop strap on either side of said aperture to prevent the extent of travel afforded the loop strap within the shackle, a link secured in one end of the loop strap that is receivable within the shackle whereby the link can be secured to the lock when the shackle is locked to the body section thereof.

9. The combination of claim 8 wherein said shackle is a U-shaped member that is deformed so that midsection of the two legs are placed in contact to establish a closed aperture at the outer end thereof.

10. The combination of claim 8 wherein said riser strap is looped through the heel binding of the ski and the two ends thereof are affixed to the body section of the lock by a rivet.

11. The combination of claim 8 wherein one of said stops is located at the end of said loop strap opposite that in which said link is secured whereby the loop strap can be passed through the aperture to its full extent.

* * * * *